United States Patent [19]

Bonsor

[11] Patent Number: 4,869,146

[45] Date of Patent: Sep. 26, 1989

[54] MUSICAL DRUM

[75] Inventor: Clive W. L. Bonsor, Knighton, England

[73] Assignee: Premier Percussion Limited, Wigston, England

[21] Appl. No.: 151,872

[22] Filed: Feb. 3, 1988

[30] Foreign Application Priority Data

Feb. 6, 1987 [GB] United Kingdom ..... 8702670

[51] Int. Cl.[4] ..... G10D 13/02

[52] U.S. Cl. ..... 84/413; 84/411 R

[58] Field of Search ..... 84/411 R, 413, 415

[56] References Cited

U.S. PATENT DOCUMENTS 1,090,426 3/1914 Thomas ..... 84/411 R
3,635,119 1/1972 Thompson ..... 84/411 R
3,981,220 9/1976 Clark ..... 84/415
4,448,105 5/1984 Cordes ..... 84/413

*Primary Examiner*—Lawrence R. Franklin
*Attorney, Agent, or Firm*—Charles E. Brown; Charles A. Brown

[57] ABSTRACT

A musical drum is disclosed having an outer cage to which both top and bottom counterhoops are connected in an independently adjustable manner. An intermediate hoop (16) is provided between the top and bottom counterhoops (20, 22) to which a plurality of adjusting bolt assemblies (34, 24) for the top and bottom counterhoops (20, 22) are connected. The adjusting bolt assemblies (34) for the bottom counterhoop (22) are circumferentially offset with respect to the adjusting bolt assembles (24) for the top counterhoop (20).

8 Claims, 2 Drawing Sheets

MUSICAL DRUM

The present invention relates to a musical drum and in particular to a military musical drum and more especially a pipe band drum.

A musical drum consists of a cylindrical drum shell over the open ends of which respective drum heads are tensioned. Each drum head consists of a circular "skin" having a diameter slightly greater than the diameter of the drum shell, a flesh hoop being secured to the periphery of the skin. The skin rests against an annular bearing edge of the drum shell with the flesh hoop lying alongside the outer surface of the drum shell.

In order to tension the skin, pressure is applied to the flesh hoop in a direction away from the bearing edge. Pressure may be applied to the drum shell in a variety of ways. Many of the ways involve the provision of fittings such as brackets secured to the drum shell and against which a skin tensioning device may bear or be secured. A disadvantage to this type of arrangement is that the inner cylindrical surface of the drum shell is disturbed, for example by securing bolts for the brackets, thus removing the drum shell's clean inner surface and so causing a deterioration in the sound quality produced. A further problem associated with this type of drum is that particularly with military and pipe band drums, as the pressure on the skin has increased, so mechanical distortion of both the top and bottom counterhoops has occured. Further, with the present levels of pressure on military and pipe band drums (typically 80 to 100 psi) there has been a tendency for the drum brackets to be dislodged from the drum shell thus altering the skin pressures.

On other types of drum, the drum shell is located within a cage, the skin tensioning devices being secured to the cage rather than the drum shell. This type of construction enables the drum shell's inner surface to remain clean and at the same time enables at least some of the stress resulting from tensioning of the drum heads to be carried by the cage rather than the drum shell per se.

In one known construction a counterhoop is placed over each drum head and a plurality of peripherally spaced bolts connect between the top and bottom counterhoops.

In accordance with the present invention there is provided a musical drum having an outer cage to which both top and bottom counterhoops are connected in an independently adjustable manner, an intermediate hoop between the top and bottom counter hoops to which a plurality of respective adjusting bolt assemblies for the top and bottom counterhoops are connected, the adjusting bolt assemblies for the bottom counterhoop being circumferentially offset with respect to the adjusting bolt assemblies for the top counterhoop.

Figure 1:
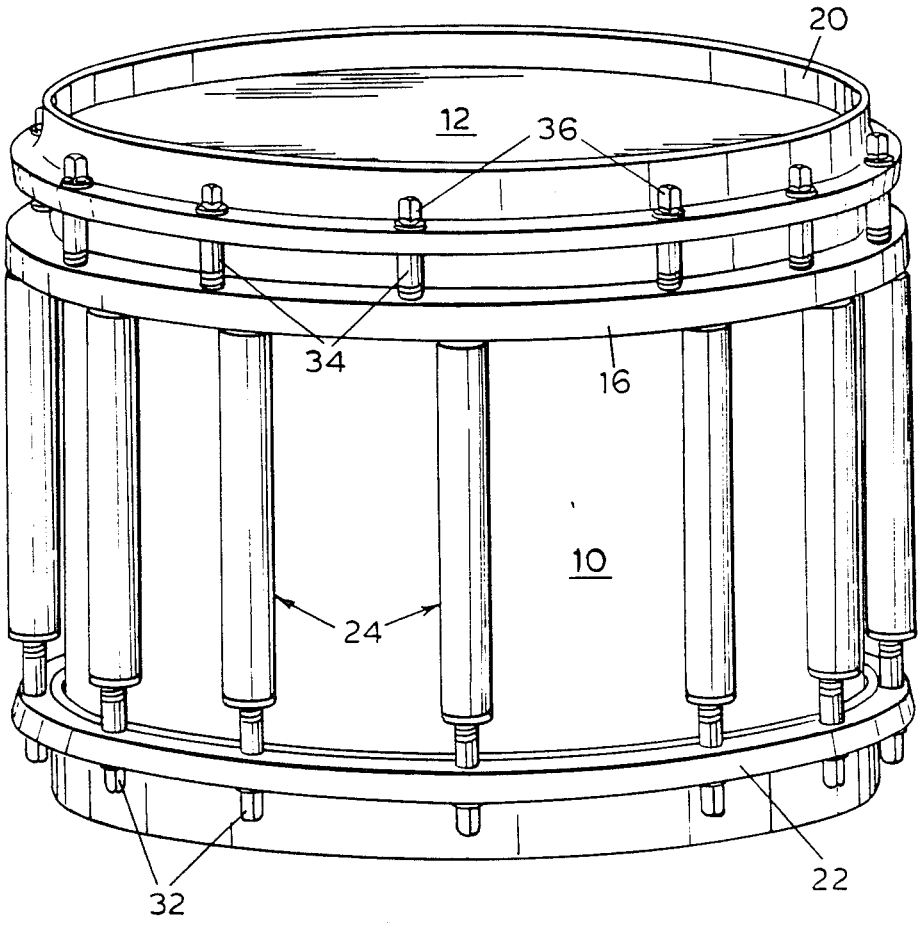
Figure 2:
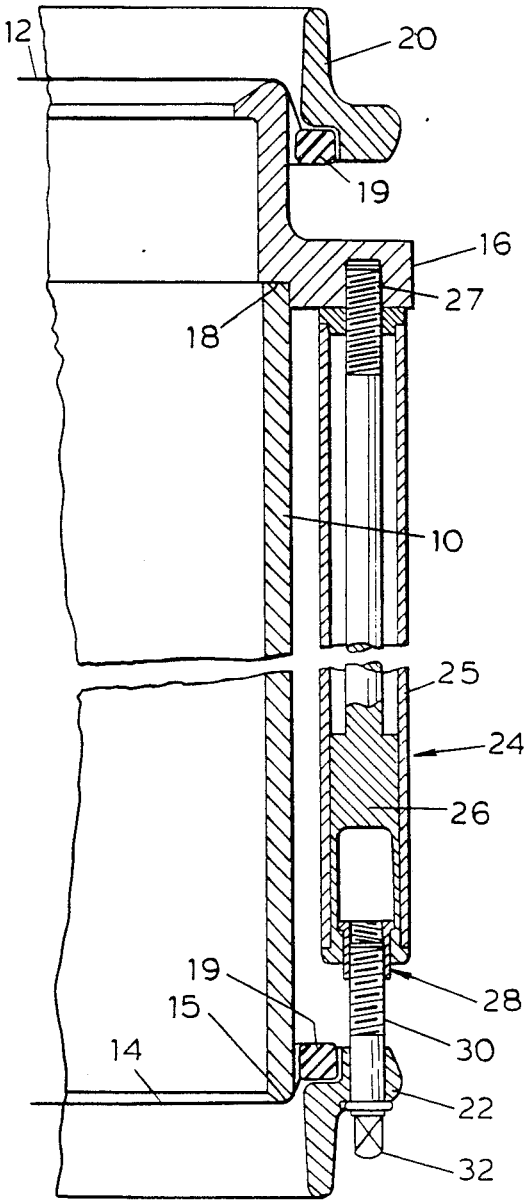
Figure 3:
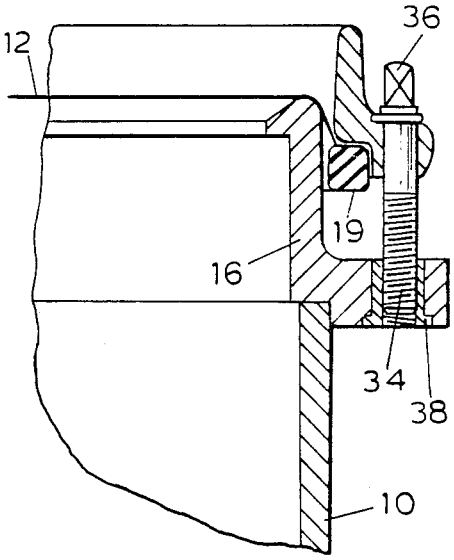

The invention will now be described further by way of example with reference to the accompanying drawings in which:

FIG. 1 is a perspective view of a musical drum in accordance with the present invention, FIG. 2 is a sectional view taken through a longitudinal plane lying at the centre of one of the tensioning bolts for the bottom counterhoop of the drum shown in FIG. 1, and FIG. 3 is a sectional view taken through a longitudinal plane lying at the centre of one of the tensioning bolts for the top counterhoop of the drum shown in FIGS. 1 and 2.

The drum illustrated in the drawings consists of a cylindrical drum shell 10 to the open ends of which respective top and bottom drum heads 12, 14 are applied, the bottom head 14 being stretched directly over a bearing edge 15 of the shell and top head 12 being stretched over an intermediate hoop 16 located by flanges 18 onto the top of the drum shell. Both drum heads 12, 14 contain flesh hoops 19 secured to a peripheral edge of each hoop. Top 20 and bottom 22 counterhoops are placed over each drum head and caused to engage the respective flesh hoops 18.

The lower head 14 is tensioned by a plurality of spaced tensioning bolt assembles which extend between the intermediate hoop 16 and the bottom counterhoop 22. As may best be seen from FIG. 2 each assembly 24 consists of a rod 26 the upper end of which is externally threaded and engages an internally threaded bore 27 in the underside of the intermediate hoop 16. The lower end of the rod is connected via a bracket nut 28 to a bolt 30. The head of the bolt 30 accepts a standard drum key by means of which the bolt can be adjusted. Each tensioning bolt assembly is housed within a cylindrical sleeve 25.

The upper head 12 is also tensioned by a plurality of spaced tensioning bolts 34, which are best seen in FIG. 3, and which extend between the intermediate hoop 16 and the top counterhoop 20. The longitudinal axes of the tensioning bolt assembles 24 are offset from those of the tensioning bolts 34. The provision of the intermediate hoop 16 together with the offset relationship between the bolts 24, 34 relieves the stress gradient between the top and bottom counterhoops 20, 22. Further more, because the bolts 24, 34, are angularly offset, the stress applied to counterhoops is spread thus relieving or eliminating the tendency for the counterhoops to distort mechanically.

As may be seen from FIG. 3 the head 36 of each bolt 34 is key adjustable by a standard drum key, the location of the head being readily available to a drummer. The bolt 34 is threaded into an internally threaded steel bush 38 received as a force fit into an aperture therefore in a lower surface of the intermediate hoop 16.

I claim:

1. A musical drum having a drum shell with a clean inner cylindrical surface and a pair of opposed ends, drum heads placed on each end of the shell with top and bottom counterhoops located over the respective drum heads to enable independent adjustment thereof, an intermediate hoop located on the top of the shell beneath the top counterhoop, a plurality of adjusting bolt assemblies for the top head connected between the top counterhoop and the intermediate hoop to enable the tension on the top head to be adjusted against the intermediate hoop, a plurality of adjusting bolt assemblies for the bottom head connected between the bottom counterhoop and the intermediate hoop to enable the tension on the bottom head to be adjusted against a bottom end of the shell by urging the bottom counterhoop and the intermediate hoop towards one another, the bolts for the top head adjusting assembly being circumferentially offset with respect to the bolts of the bottom head adjusting assembly.

2. A musical drum as claimed in claim 1 in which each adjusting bolt assembly for the top counterhoop comprises a bolt the head of which is key adjustable, the bolt being threaded into an internally threaded bush received as a force fit into an aperture in a surface of the intermediate hoop.

3. A musical drum so claimed in claim 2 which each adjusting bolt assembly for the bottom counterhoop comprises a rod one of which is externally threaded and engages an internally threaded bore in the underside of the intermediate hoop, the other end of the rod being connected via a bracket nut to an adjusting bolt.

4. A musical drum so claimed in claim 1 in which each adjusting bolt assembly for the bottom counterhoop comprises a rod one of which is externally threaded and engages an internally threaded bore in the underside of the intermediate hoop, the other end of the rod being connected via a bracket nut to an adjusting bolt.

5. A musical drum according to claim 4 in which the bolt has a head which is key adjustable.

6. A musical drum having a drum shell with a clean inner cylindrical surface, said drum shell having a pair of opposed ends, a hoop assembly being seated upon at least one of said ends of said drum shell, said hoop assembly having an extension portion which extends parallel with said drum shell, said hoop assembly also having a hoop portion which extends generally perpendicular to said drum shell, said extension portion having an end which is opposed to said ends of said drum shell, a pair of drum heads, one of said drum heads being seated upon said extension portion end and the other of said drum heads being seated upon the other of said ends of said drum shell, each of said drum heads being independently adjustable with respect to its associated end, top and bottom counterhoops being located over respective drum heads to enable independent adjustment thereof, a plurality of adjusting bolt assemblies for said one drum head being connected between said top counterhoop and said hoop assembly whereby tension on said one drum head may be adjusted in tension against said hoop assembly, a plurality of adjusting bolt assemblies for said other drum head being connected between said bottom counterhoop and said hoop assembly whereby tension on said other drum head may be adjusted putting said other drum head in tension against said other end of the shell, and the bolts for said one drum head adjusting assemblies being circumferentially offset with respect to the bolts of said other drum head adjusting assemblies.

7. A musical drum according to claim 6, wherein said adjusting bolt assemblies of said one and said other drum heads being connected to said hoop portion of said hoop assembly.

8. A musical drum according to claim 7, wherein said hoop portion being positioned intermediate of said top and bottom counterhoops.

* * * * *